United States Patent [19]

Darnell

[11] 4,158,353

[45] Jun. 19, 1979

[54] POSITIVE CRANK CASE VENTILATION VALVE AND INTERNAL COMBUSTION ENGINE INCLUDING THE SAME

[75] Inventor: William E. Darnell, Mentor, Ohio

[73] Assignee: Towmotor Corporation, Mentor, Ohio

[21] Appl. No.: 844,148

[22] Filed: Oct. 21, 1977

Related U.S. Application Data

[63] Continuation of Ser. No. 670,923, Mar. 26, 1976, abandoned.

[51] Int. Cl.[2] ..... F02M 25/06

[52] U.S. Cl. ..... 123/119 B; 123/41.86

[58] Field of Search ..... 123/119 B, 41.86; 137/509

[56] References Cited

U.S. PATENT DOCUMENTS

| | | | |
|---|---|---|---|
| 2,585,863 | 12/1952 | Smith | 137/53 |
| 2,775,960 | 1/1957 | Druzynski | 123/119 B |
| 3,144,011 | 8/1964 | Anthes | 123/119 B |
| 3,144,044 | 8/1964 | Anthes | 123/119 B |

*Primary Examiner*—Louis J. Casaregola

*Attorney, Agent, or Firm*—Wegner, Stellman, McCord, Wiles & Wood

[57] ABSTRACT

An internal combustion engine including an air intake and a crank case, a positive crank case ventilation valve having a valve body, a cavity within the valve body, a first valve seat within the cavity, a second valve seat within the cavity and smaller than the first valve seat, a valve member within the cavity and configured to substantially close the cavity to the ambient and yet be movable therein to a position seated against both the valve seat and to a position spaced from the seond valve seat, a passage terminating at the second valve seat, a port terminating in the cavity between the first and second valve seats, a conduit extending between the passage and the air intake of the engine, and a conduit extending between the port and the crank case. The difference in areas of the two valve seats permits crank case pressure to be closely controlled.

8 Claims, 1 Drawing Figure

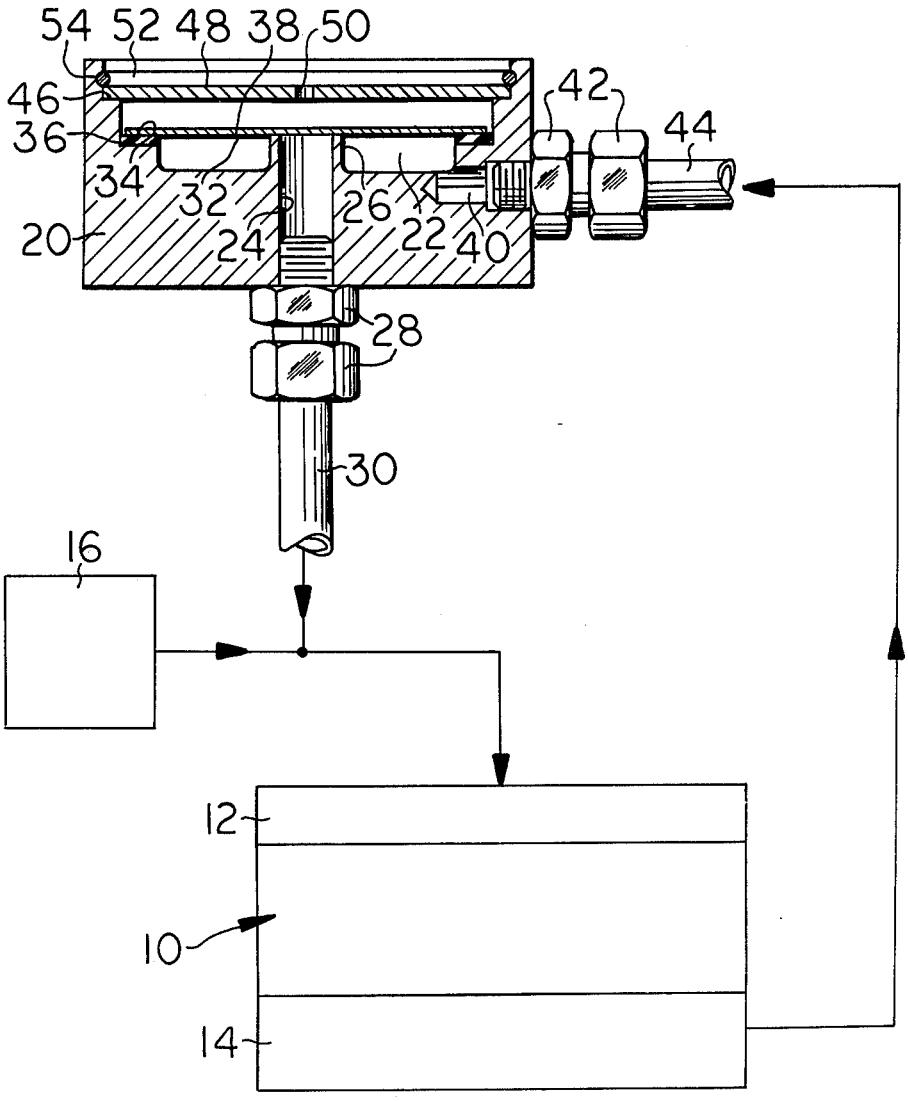
54
52
48
38
50
46
36
34
32
26
22
40
42
44
20
24
28
30
16
12
10
14

POSITIVE CRANK CASE VENTILATION VALVE AND INTERNAL COMBUSTION ENGINE INCLUDING THE SAME

CROSS REFERENCE

This application is a continuation of my commonly assigned, copending application Ser. No. 670,923, filed Mar. 26, 1976 (abandoned) and bearing the same title.

BACKGROUND OF THE INVENTION

This invention relates to internal combustion engines. More particularly, it relates to such engines including positive crank case ventilation valves and to valve constructions for positive crank case ventilation valves.

Ever-increasing concern for air pollution has, in recent years, seen mandatory requirements for positive crank case ventilation valves in internal combustion engines. Typically, such valves are employed in a system wherein noxious fumes within the crank case are cycled to the clean air side of the air intake for the engine so as to be drawn into the engine and consumed during the usual combustion process when gas pressure in the crank case reaches some predetermined value. Heretofore, such valves have typically employed springs as part of their working mechanism to assist in controlling the opening and closing of the valve in response to changes in pressure within the crank case.

In general, such systems have been satisfactory, but owing to the employment of elements such as springs, there is the difficulty of achieving good uniformity in response from one valve to the next. There is also the possibility that, after extended use, and substantial cyclic flexure of the spring, the same may fail to thereby interfere with proper operation of the system.

SUMMARY OF THE INVENTION

It is the principal object of the invention to provide a new and improved internal combustion engine including a positive crank case ventilation valve. It is also an object of the invention to provide a new and improved positive crank case ventilation valve structure.

An exemplary internal combustion engine made according to the invention includes an air intake and a crank case and a positive crank case ventilation valve having a valve body. A cavity is within the valve body. There is a first valve seat within the cavity and a second valve seat within the cavity, the second valve seat being smaller than the first valve seat. A valve member is disposed within the cavity and is configured to substantially close the cavity to the ambient and yet be movable therein between a position seated against both valve seats and a position spaced from the second valve seat. A passage terminates at the second valve seat and a port terminates in the cavity between the first and second valve seats. The passage is connected to the air intake of the engine, while the port is connected to the crank case of the same. Positive crank case pressures tend to move the valve member away from the second seat while the induction of air in the intake tends to hold the valve member against the second valve seat. The ratio of the areas bounded by the two valve seats determines the pressure differential between the air intake and the crank case whereat the valve member will move from the second valve seat to establish fluid communication between the port and the passage for positive crank case ventilation. By appropriately selecting the ratio, very fine control of crank case pressure may be achieved.

In a preferred embodiment, the valve member is a substantially planar disc and the first and second valve seats lie in a common plane. Generally, the cavity comprises an annular space about the second valve seat and the first valve seat comprises an annular shoulder about the periphery of the cavity.

In general, the cavity will be closed by a cover received therein, which cover is provided with a vent extending through the same to establish fluid communication between the exterior of the valve body and the side of the valve member opposite the valve seat. Means are provided for securing the cover to the valve body.

A positive crank case ventilation valve made according to the invention will generally have some or all of the characteristics mentioned in the preceding paragraphs.

Other objects and advantages will become apparent from the following specification taken in connection with the accompanying drawings.

DESCRIPTION OF THE DRAWINGS

The FIGURE is a sectional view of a positive crank case ventilation valve made according to the invention illustrating its placement in an internal combustion engine system, which system is illustrated in block form.

DESCRIPTION OF THE PREFERRED EMBODIMENT

An exemplary embodiment of an internal combustion engine employing a positive crank case ventilation valve made according to the invention is illustrated in the FIGURE and is seen to include an engine, generally designated 10, including a conventional air intake 12 as well as a crank case 14. Typically, air is directed to the air intake 12 from an air filter 16. If the engine is of the type employing fuel injection or is a diesel, the air filter 16 will generally be in direct communication with the air intake 12. On the other hand, if the engine is a spark ignition engine, not employing fuel injection, a carburetor (not shown) will be interposed between the air filter 16 and the air intake.

A positive crank case ventilation valve made according to the invention includes a valve body 20 including a cavity 22 opening to one end thereof. A passage 24 within the valve body extends into the cavity 22 and is surrounded by a boss 26 generally within the center of the cavity 22. As a consequence, an annular space about the boss 26 is defined.

Suitable fittings 28 establish fluid communication between the passage 28 and a conduit 30 extending to the air intake 12 downstream of the air filter.

The upper end of the boss 26 defines a valve seat 32, which valve seat is relatively small in size.

An annular shoulder 34 extends about the periphery of the cavity 22 and receives an elastomeric ring 36 defining a further valve seat. It is to be observed that the two valve seats defined by the boss 26 and the elastomeric ring 36 are co-planar.

Within the cavity 22 there is disposed a planar disc 38 which may seat against both of the valve seats, as illustrated in the FIGURE. As seen in the drawing, the valve member 38 is slightly smaller than the upper portion of the cavity 22 and thus substantially closes the same to the ambient. Because of this configuration, the valve member 38 may move upwardly in the cavity somewhat away from the valve seats 32 and 36. When such occurs, fluid communication between that portion of the cavity 22 below the valve member 38 and the passage 24 is established.

A port 40 is in fluid communication with the cavity 22 between the valve seats 32 and 36 and by means of fittings 42 is connected to a conduit 44 which is in fluid communication with the crank case 14.

The valve body 20, and specifically the cavity 22, is provided with an additional annular shoulder 46 of greater diameter than the shoulder 34. A cover 48 is receivable on the shoulder 46 to substantially close the cavity and is provided with a vent 50 whereby fluid communication between the exterior of the body and the side of the valve member 38 opposite from the valve seats is established. A spring retaining ring 52 may be received in an annular groove 54 above the shoulder 46 for positively retaining the cover 48 in place.

Operation is as follows. Those skilled in the art will recognize that the pressures existing in the crank case 14 will be at atmospheric pressure or greater, while the pressures existing at the air intake 12 will be less than atmospheric. It will also be recognized that by reason of the difference in size of the two valve seats, the crank case pressure will be directed against the underside of the valve member 48, and specifically, to a far greater area of the same than will be the air intake pressure. Typically, the ratio of the areas will be about 10:1, although other ratios may be used as desired.

In the case of the exemplary ratio mentioned in the preceding paragraph, should the crank case pressure exceed 1/10 of the vacuum in the air intake, it will cause the valve member 38 to move upwardly within the body 20 and away from sealing contact with the valve seats 32 and 36. As a consequence, crank case gases may flow from the port 40 through the cavity 22 to the passage 24 to be drawn into the air intake and consumed within the engine 10. On the other hand, when the crank case pressure is less than 1/10 that of the vacuum at the air intake, the valve member 38 will assume the position illustrated, precluding fluid communication from the crank case to the air intake allowing most efficient engine operation.

It will accordingly be appreciated that by suitably configuring the valve seats to control the ratio of areas subscribed by each, any desired relative pressure control relationship can be attained, allowing very fine control of crank case ventilation while eliminating the possibility of pressure buildup to the point that crank case fumes could leak to the atmosphere.

It will be appreciated that a valve made according to the invention does not require the use of springs which can fracture and wear out and that by use of a ratio of areas to achieve a control function as opposed to springs, much greater uniformity of control from one valve assembly to the next may be easily achieved.

What is claimed is:

1. An internal combustion engine including an air intake and a crank case, a positive crank case ventilation valve having a valve body, a cavity within said body, a first valve seat within said cavity, a second valve seat within said cavity and smaller than said first valve seat, a valve member within said cavity and sized to substantially close said cavity to the ambient and yet be movable therein to a position seated against both said valve seats, and to a position spaced from said valve seats, a passage terminating at said second valve seat, and a port terminating in said cavity between said first and second valve seats; means establishing fluid communication between said passage and said air intake; and means establishing fluid communication between said port and said crank case.

2. The internal combustion engine of claim 1 wherein said valve member is a substantially planar disc and said first and second valve seats lie in a common plane.

3. The internal combustion engine of claim 2 wherein said cavity comprises an annular space about said second valve seat and said first valve seat comprises an annular shoulder about the periphery of said cavity.

4. The internal combustion engine of claim 3 wherein a cover is received in said cavity for closing the same, and further including a vent extending through said cover, and means for securing said cover to said valve body.

5. A positive crank case ventilation valve for use in combination with an internal combustion engine including an air intake and a crank case, said valve comprising a valve body, a cavity in said valve body, a passage extending through said valve body into said cavity centrally thereof, said passage being adapted to be connected to the air intake of an internal combustion engine, a boss within said cavity and about said passage and having an end defining a valve seat, a shoulder extending about the periphery of said cavity and spaced from said boss and defining a second valve seat, and a disc-like valve member within said cavity and movable therein between positions simultaneously sealing against and spaced from both said valve seats, a port in said body in fluid communication with said cavity between said shoulder and said boss and adapted to be connected to the crank case of an internal combustion engine; and means establishing fluid communication between the exterior of said valve body and said valve member oppositely of said valve seats.

6. The positive crank case ventilation valve of claim 5 wherein said last-named means comprises a cover including a vent secured to said valve body oppositely of said boss to substantially close said cavity.

7. The positive crank case ventilation valve of claim 5 including an additional peripheral shoulder in said valve body and spaced from said first shoulder, a cover disposed on said additional shoulder, means for securing said cover against said additional shoulder, and a vent extending through said cover.

8. The positive crank case ventilation valve of claim 5 wherein at least one of said valve seats is at least partially defined by an elastomeric member.

* * * * *